US011305565B2

(12) United States Patent
Kim

(10) Patent No.: US 11,305,565 B2
(45) Date of Patent: Apr. 19, 2022

(54) ASSEMBLY STRUCTURE OF PRINTER CASE

(71) Applicant: Shin Heung Precision Co., Ltd, Seoul (KR)

(72) Inventor: Han-Bong Kim, Seoul (KR)

(73) Assignee: Shin Heung Precision Co., Ltd, Seoul (KR)

( * ) Notice: Subject to any disclaimer, the term of this patent is extended or adjusted under 35 U.S.C. 154(b) by 0 days.

(21) Appl. No.: 16/783,946

(22) Filed: Feb. 6, 2020

(65) Prior Publication Data

US 2020/0254795 A1 Aug. 13, 2020

(30) Foreign Application Priority Data

Feb. 13, 2019 (KR) ..... 10-2019-0016852

(51) Int. Cl.
*B41J 2/325* (2006.01)
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

2002/0056354 A1* 5/2002 Morita ..... B26D 1/085 83/564
2016/0185140 A1* 6/2016 Ishida ..... B26D 1/065 347/104

FOREIGN PATENT DOCUMENTS

| | | | | |
|---|---|---|---|---|
| CN | 1101993 | A | | 4/1995 |
| CN | 1315253 | A | | 10/2001 |
| CN | 2923321 | Y | | 7/2007 |
| JP | 5223854 | B2 | | 6/2013 |
| JP | 5265972 | B2 | | 8/2013 |
| KR | 10-2001-0093651 | A | | 10/2001 |
| KR | 20160091608 | A | * | 8/2016 |
| KR | 20160091608 | A | | 8/2016 |
| KR | 10-1679197 | B1 | | 11/2016 |
| KR | 20-2017-0003549 | U | | 10/2017 |

* cited by examiner

*Primary Examiner* — Erica S Lin
*Assistant Examiner* — Tracey M McMillion
(74) *Attorney, Agent, or Firm* — Novick, Kim & Lee, PLLC; Jae Youn Kim; Jihun Kim

(57) ABSTRACT

A printer case assembly structure includes a print main body; a first case installed at a portion of the printer main body; a second case installed to surround the print main body except for an installing area of the first case and a cover installation opening part area; a latching sill part formed in the print main body and the first case to assemble the first case; a separation prevention part formed in the first and second cases to prevent the first case from being separated from the latching sill part; and an assembly hook unit formed in a hook structure in the printer main body and the second case to assemble the second case.

12 Claims, 15 Drawing Sheets

ASSEMBLY STRUCTURE OF PRINTER CASE

BACKGROUND OF THE INVENTION

1. Field of the Invention

The present invention relates to a printer case assembly structure, and more particularly, to a printer case assembly structure by which the assembly and disassembly of a printer exterior case can be quickly performed through a simple manual operation without relying on a separate tool.

2. Description of Related Art

The contents described in this section merely provide background information on the embodiments of the present invention and do not constitute a prior art. Various types of printers, such as a printer connected to a computer network to print on paper media in an inkjet scheme, a receipt or label printer in a thermal printing scheme, a 3D printer, a semiconductor or circuit fabrication printer, a recent post-it printer proposed for office use, and the like has been released according to print media, printing schemes, and customized usage schemes.

Hereinafter, an assembly structure of a conventional thermal printer case based on a thermal printer structure disclosed in Korean Registered Patent Publication No. 10-1679197 filed by the applicant will be exemplarily described.

In general, a thermal printer, which is a type of non-impact printer that uses heat-sensitive recording paper (hereinafter referred to as 'printing paper') and applies heat to the paper with a printer head (thermal head) to print a text or picture thereon through color formation, is relatively simple and compact in structure, and small in volume, so that the thermal printer is suitable for printing in simple receipt or specification, so the thermal printer has been used as a POS printer.

Patent 197' discloses a printer capable of changing the feeding scheme of the printing paper between a front feeding scheme and a top feeding scheme, which is a thermal printer having greatly improved user convenience and merchandise.

That is, as shown in FIGS. 1A and 1B, the printer of the 197' patent includes a main body casing 200, a top cover 300, a front cover 400, a print head unit 500, and a platen roller unit, and a guide block 700. In the case where the printing paper p of the printer 100 is to be used in a front feeding scheme, as shown in FIG. 1A, the user attaches the guide block 700 to a first receiving part of the top cover 300. When the printing paper p is used in a top feeding scheme, as shown in FIG. 1B, the user separates the guide block 700 in a scheme of attaching the guide block 700 to the second receiving part. As described above, the user can change the feeding scheme of the print paper of the printer 100 by changing the installation location of the guide block 700.

In terms of assembly structure, the printer 100 of the 197' patent, as shown in the regions (a) and (b) indicated by dashed lines in FIGS. 1A and 1B, A fastening boss for assembling is formed on the fastening portion of the front cover 400, the fastening portion inside the main body 200, and is assembled by fastening the fastening screw to the fastening boss.

Accordingly, the printer 100 has to be provided with a fastening boss for fastening a fastening screw and a reinforcing part for reinforcing the fastening, so that the detailed structure becomes complicated and the fastening space has to be secured. As the overall size of the case became larger, it is necessary to improve the assembly structure in order to implement a compact product.

In more detail, the printer 100 requires the use of an assembly tool such as a screw driver for assembly of the fastening screw during mass production of the product, so that assembly operations of various stages such as gripping of assembly tool, moving, fastening, and the like are required. In addition, as the assembly time increases, productivity decreases. In another aspect, this causes an increase in assembly cost, and the production cost may increase due to the addition of subsidiary materials such as fastening screws, washers, and the like. In addition, the repair time and cost increase of the product is inevitable even during A/S, and the screw fastening scheme may cause wear or coupling loosening due to frequent disassembly/assembly.

Therefore, there is a need to simplify the parts and the process of assembling the printer case, and in detail, it is the motive for inventing a toolless case assembly structure.

3. Documents of Related Art (Patent document 0001) Korean Registered Patent Publication No. 10-1679197 (issued on Jan. 18, 2016) entitled 'Printer capable of changing a feeding scheme'

(Patent document 0002) Japanese Registered Patent Publication No. 5265972 (published on May 10, 2017) entitled 'Printer having cutter'

(Patent document 0003) Japanese Registered Patent Publication No. 5223854 (published on Mar. 22, 2013) entitled 'Printer'

SUMMARY OF THE INVENTION

To solve the problems described above, an object of the present invention is to provide a printer case assembly structure in which the disassembly and assembly process can be easily and quickly performed without using a separate assembly and disassembly tool.

To achieve the objects described above, according to one aspect of the present invention, there is provided a printer case assembly structure which includes a print main body; a first case installed at a portion of the printer main body; a second case installed to surround the print main body except for an installing area of the first case and a cover installation opening part area; a latching sill part formed in the print main body and the first case to assemble the first case; a separation prevention part formed in the first and second cases to prevent the first case from being separated from the latching sill part; and an assembly hook unit formed in a hook structure in the printer main body and the second case to assemble the second case.

The assembly hook unit may include a support hook member including an elastic support part protruding from the printer main body and a support hook formed on the elastic support part; and a support hook latching part formed in the second case while facing the support hook member to latch with the support hook member. The assembly hook unit may include a support hook member including an elastic support part protruding from the second case and a support hook formed on the elastic support part; and a support hook latching part formed in the print main body while facing the support hook member to latch with the support hook member. The support hook member may be further formed with a disassembly handle part.

The second case may include a bottom plate formed with an opening, side plates placed on both lateral sides of the bottom plate, a rear plate placed on a rear portion of the bottom plate, and a main body receiving plate extending parallel to the bottom plate on the rear plate, the support hook latching part is formed at one side of a plate-shaped body of the main body receiving plate and a main body support protrusion part placed on a bottom portion of the printer main body is formed at a free end of the plate-shaped body, and the support hook latching part includes a hook receiving protrusion part formed with an insertion hole into which the support hook member is inserted, a reinforcing protrusion part extending from the hook receiving protrusion part, and a guide wedge formed on an upper portion of the reinforcing protrusion part to guide a binding with the support hook member.

The separation prevention part may include a separation prevention groove formed in the first case; and a protrusion formed at an end of the second case facing the separation prevention groove and inserted into the separation prevention groove.

The latching sill part may include a sliding protrusion formed at both lateral sides of the first case; and a sliding protrusion moving groove including a horizontal moving groove formed in the printer main body facing the sliding protrusion, and a vertical moving groove communicating with the horizontal moving groove.

The printer case assembly structure may further include a shaking prevention protrusion formed on a contact portion between the printer main body and the first case to prevent the first case coupled to the printer main body from shaking.

The printer case assembly structure may further include an opening/closing cover part installed to the cover installation opening part of the printer main body and opened and closed for paper replacement, wherein the opening/closing cover part includes a hinge member formed with a hinge shaft having a latching hook in an arc-shaped hinge guide part, and the printer main body includes a shaft support member formed with a hinge hole into which the hinge shaft is inserted.

According to the printer case assembly structure of the present invention, assembling and disassembling of the case can be performed quickly by simple manual operation without relying on a separate tool, thereby improving the productivity and reducing the production cost and maintenance cost.

In addition, since the protrusion structure such as the fastening boss for assembly of the external case and the subsidiary materials such as the fastening screw are not needed, the detailed structure can be concisely simplified, and the case can be made compact because the fastening space of the fastening screw is not required, thereby improving the product marketability and market competitiveness.

BRIEF DESCRIPTION OF THE DRAWINGS

The above and other objects, features and other advantages of the present invention will be more clearly understood from the following detailed description when taken in conjunction with the accompanying drawings, in which:

FIG. 9A is a schematic diagram illustrating a preparation state before the assembly of the front case, and FIG. 9B is a schematic diagram illustrating a completed state of the front case assembly;

FIG. 10A is a schematic view illustrating a state in which the main case is temporarily assembled into the front case, and FIG. 10B is a schematic view illustrating a state in which the assembly of the main case is completed.

DETAILED DESCRIPTION OF THE INVENTION

Figure 1A:
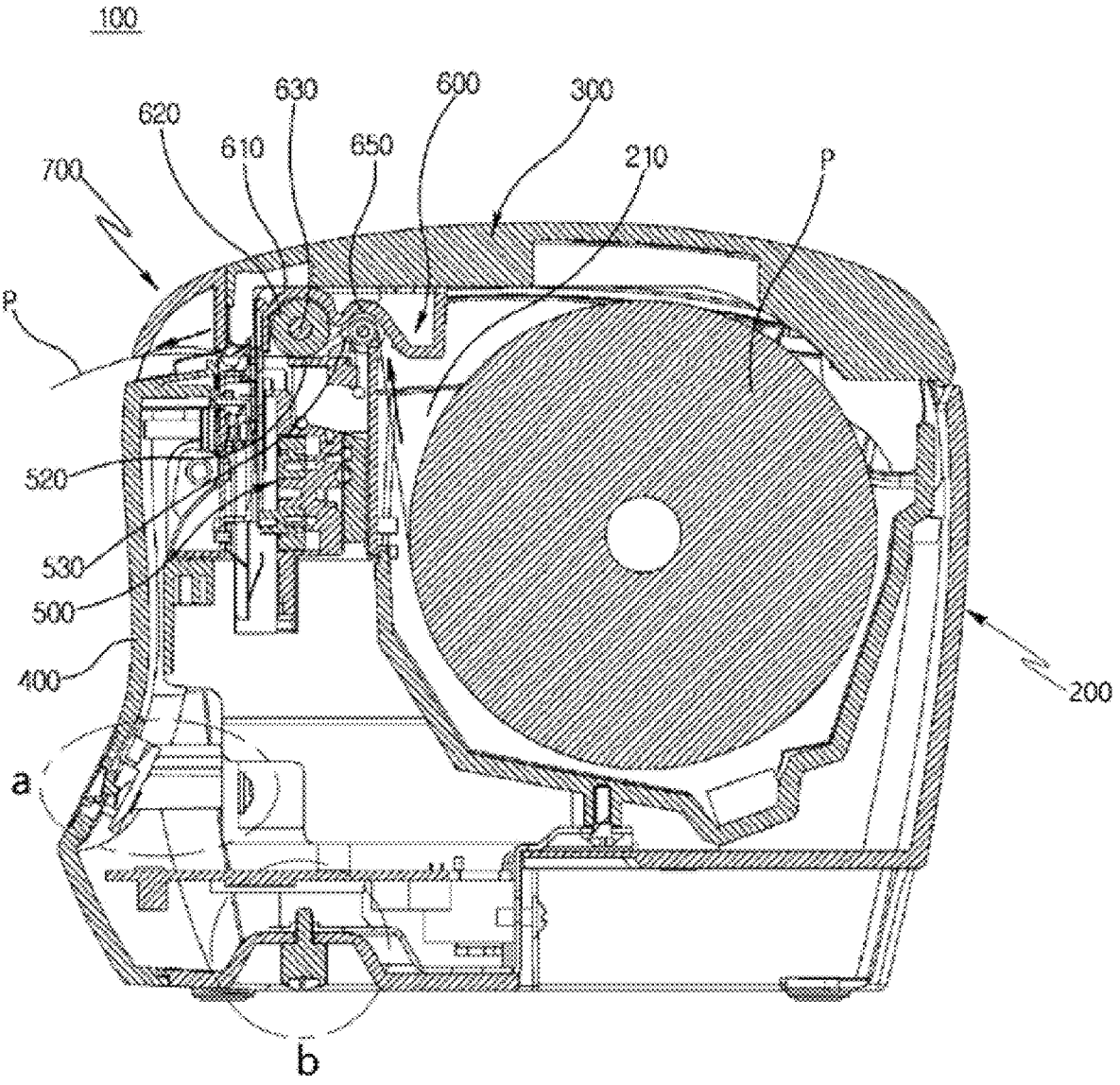
FIG. 1A Prior Art
FIGS. 1A and 1B are views illustrating a conventional printer case assembly structure.
Figure 1B:
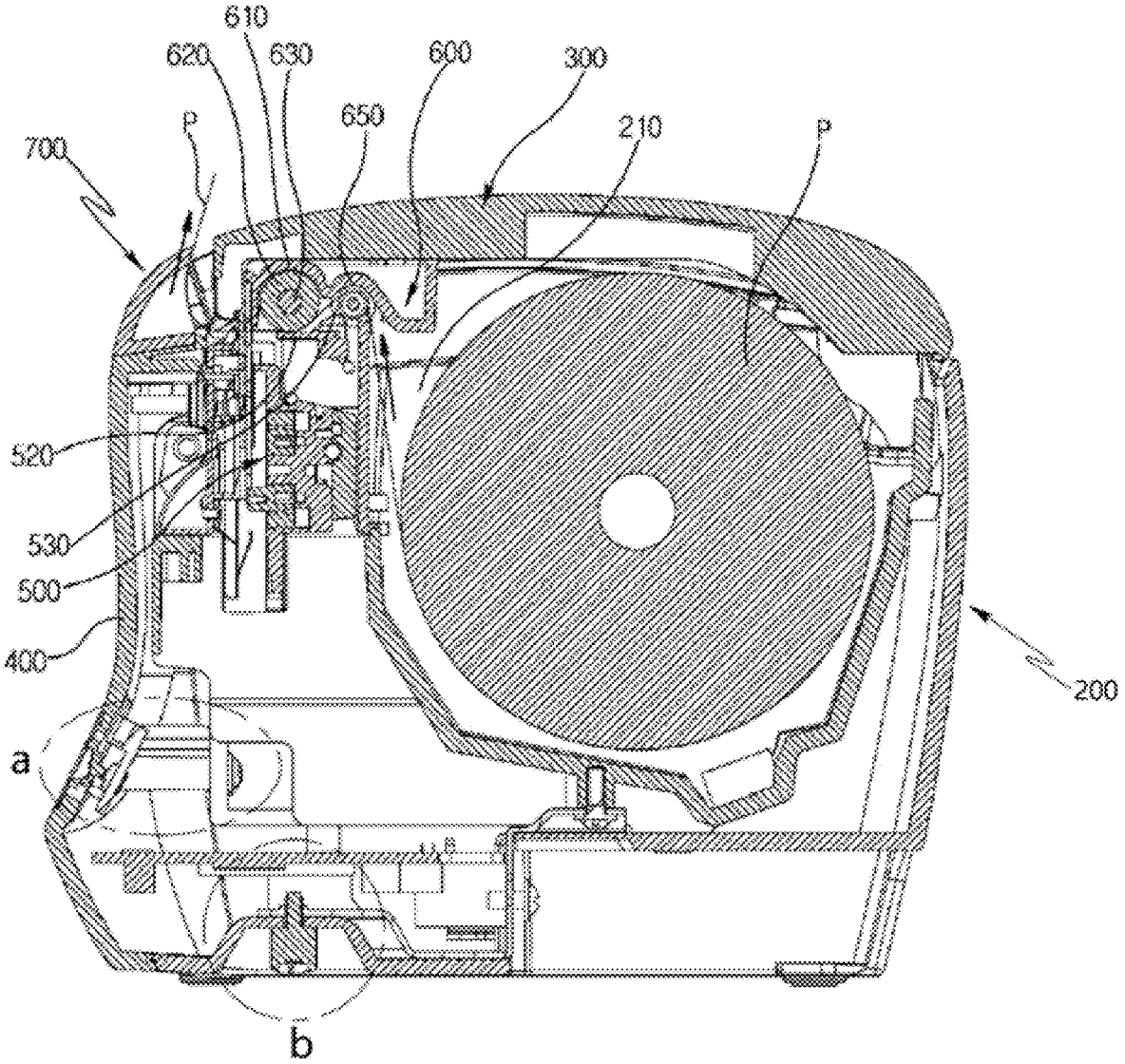
FIG. 1B Prior Art

Hereinafter, exemplary embodiments of the present invention will be described in detail with reference to FIGS. 2 to 11B. The same reference numerals are used for the same components in FIGS. 2 to 11B.

In the drawings, detailed descriptions of configurations and operations and effects thereof easily understood by those skilled in the art from general techniques will be briefly or omitted. In addition, since the present invention is characterized in the printer case assembly structure, the following description will be focused on the printer case assembly structure and the description of the remaining parts will be briefly or omitted.

Figure 2:
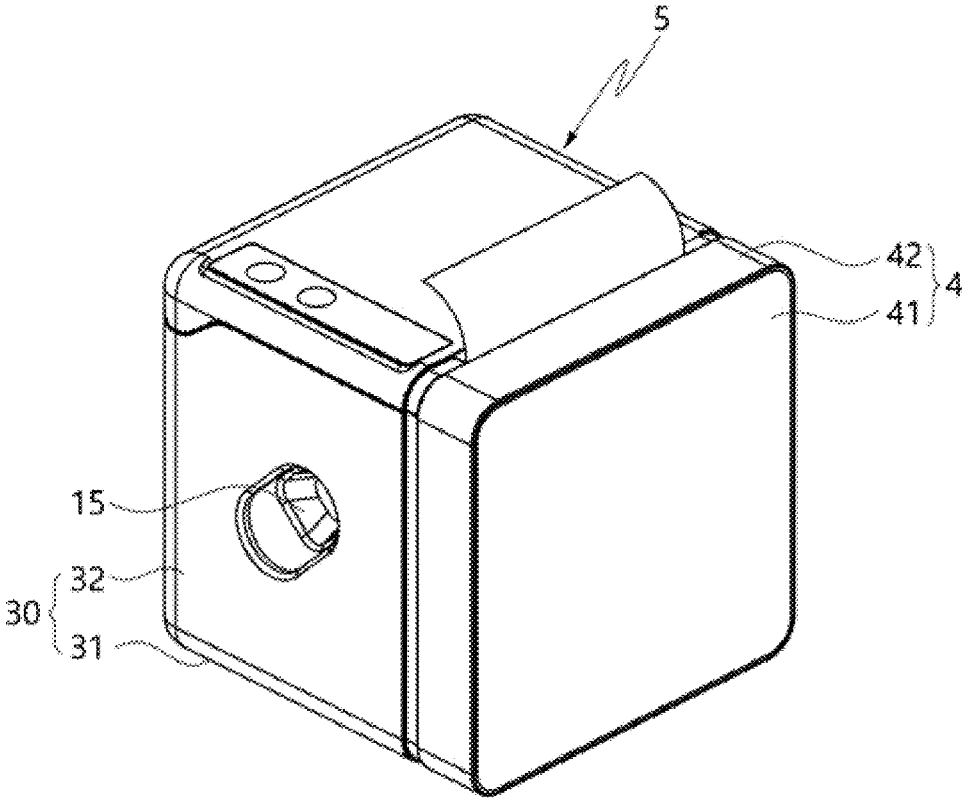
FIG. 2 is a perspective view illustrating a state in which the assembly of a printer case according to an embodiment of the present invention is completed.
Figure 3:
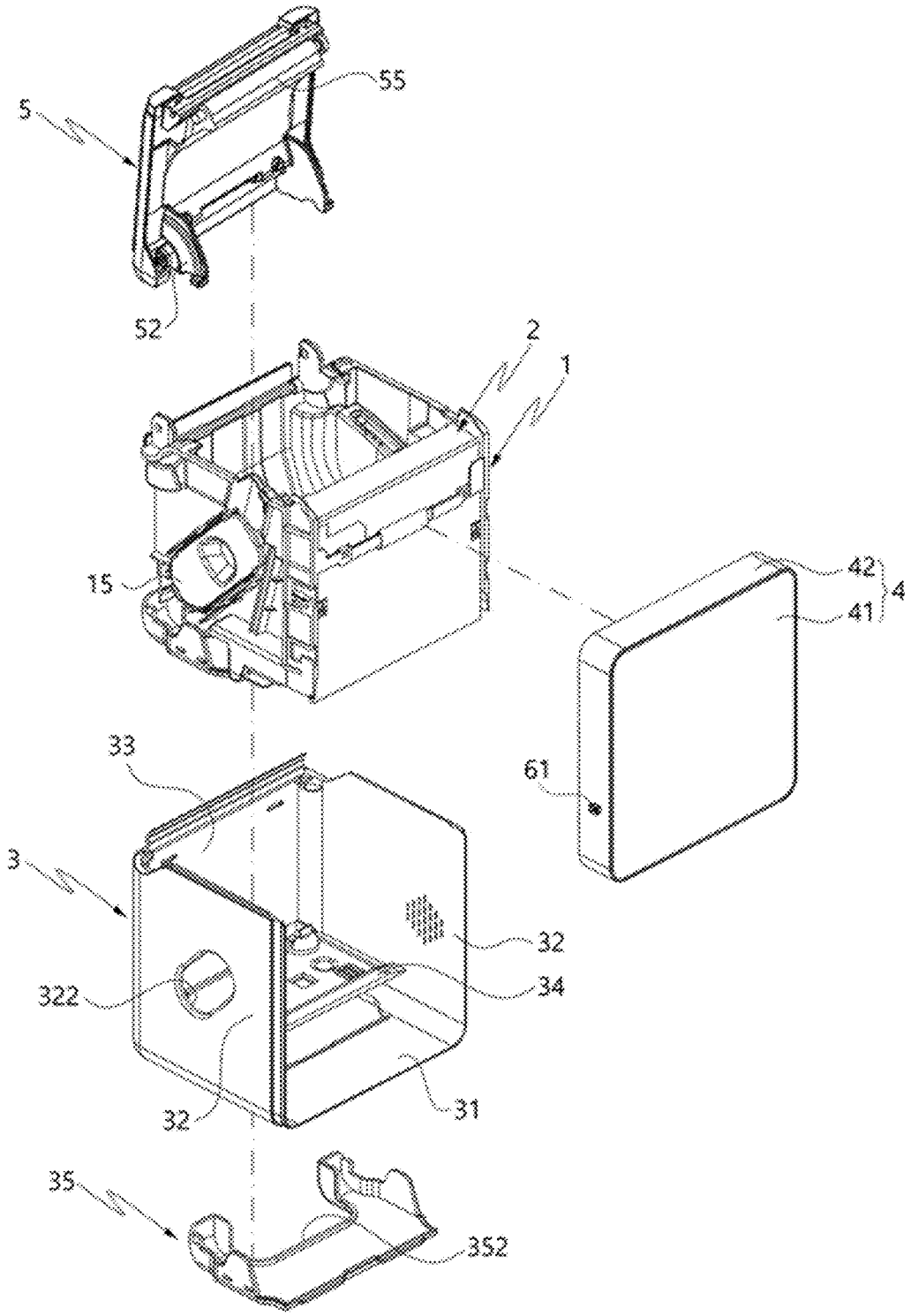
FIG. 3 is an exploded perspective view illustrating a printer case assembly structure according to an embodiment of the present invention.
Figure 4:
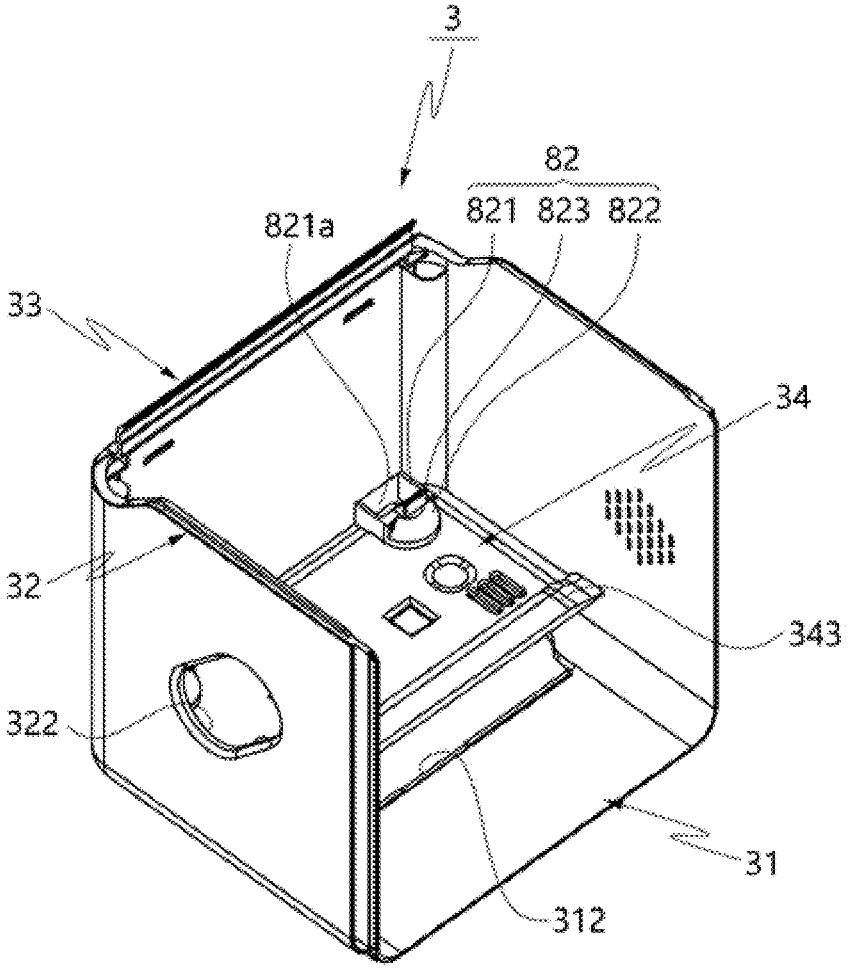
FIG. 4 is a perspective view illustrating a main case of a printer case according to an embodiment of the present invention.

FIG. 2 is a perspective view illustrating a state in which the assembly of a printer case according to an embodiment of the present invention is completed. FIG. 3 is an exploded perspective view illustrating a printer case assembly structure according to an embodiment of the present invention. FIG. 4 is a perspective view illustrating a main case of a printer case according to an embodiment of the present invention.

Referring to FIGS. 2 to 4, the printer case assembly structure according to an embodiment of the present invention characterized in that the process of disassembling or assembling a case installed outside a printer main body 1 can be performed by a simple manual operation without using any separate assembly tools.

The printer main body 1, which is formed in a substantially hexahedral shape by a plate-shaped member, includes a containing part for containing a printer head unit 2, a printed circuit board (not shown), a driving module (not shown), and the like therein. In this case, the printer head unit 2 is implemented by, for example, a thermal printer head to perform a printing operation on printing paper.

Although an exterior case may be formed in various structures according to a shape of the printer main body 1 without particular limitation on the form, in the present embodiment, the exterior case includes a main case 3, a front case 4, and an opening and closing cover 5 and is implemented to have a substantially hexahedral shape in the assembled state.

The main case 3 is formed to surround the printer main body 1 except for the front case installation area and the upper cover installation opening area, thereby forming the overall basic appearance. The main case 3 includes a bottom plate 31 formed on an installation surface in a bottom direction, a side plate 32 placed on both sides of the bottom plate 31, a rear plate 33 placed behind the bottom plate 31, and a main body receiving plate 34 extending parallel to the bottom plate 31 on the rear plate 33.

The bottom plate 31 of the main case 3 has an opening 312 formed in a plate member. A user may insert his hand through the opening 312 to perform the disassembly and assembly of the exterior case, and can be connected to a power supply unit and a communication module installed on a lower portion of the printer main body 1 by inserting an electric cable. In addition, an auxiliary cover member 35 for sealing the opening 312 is installed on the bottom plate 31. The auxiliary cover member 35 has a shape corresponding to the shape of the opening 312, and has a structure in which a cable withdrawal opening 352 is formed at the rear side so that the cable and the like can be drawn out.

The side plate 32 seals the side surface of the printer main body 1 and is formed with an operating hole 322 for operation an open lever 15 and a speaker hole.

The main body receiving plate 34 is composed of a plate-shaped body supporting the lower portion of the printer main body 1, and the plate-shaped body is formed in a lower portion of the main case 3 to provide a space in which the printer main body 1 is installed. A support hook latching part is formed at one side of the plate-shaped body proximity to the rear plate 33. As shown in FIG. 4, a main body support protrusion part 343 is formed at an end of the plate-shaped body of the main body receiving plate 34. This main body support protrusion part 343 is formed to be placed on a bottom portion of the printer main body 1.

Meanwhile, the front case 4, which is a case for sealing the front of the printer main body 1, has a front plate 41 and an edge portion 42 formed along a periphery the front plate 41 and has a rectangular cylinder shape.

Figure 5:
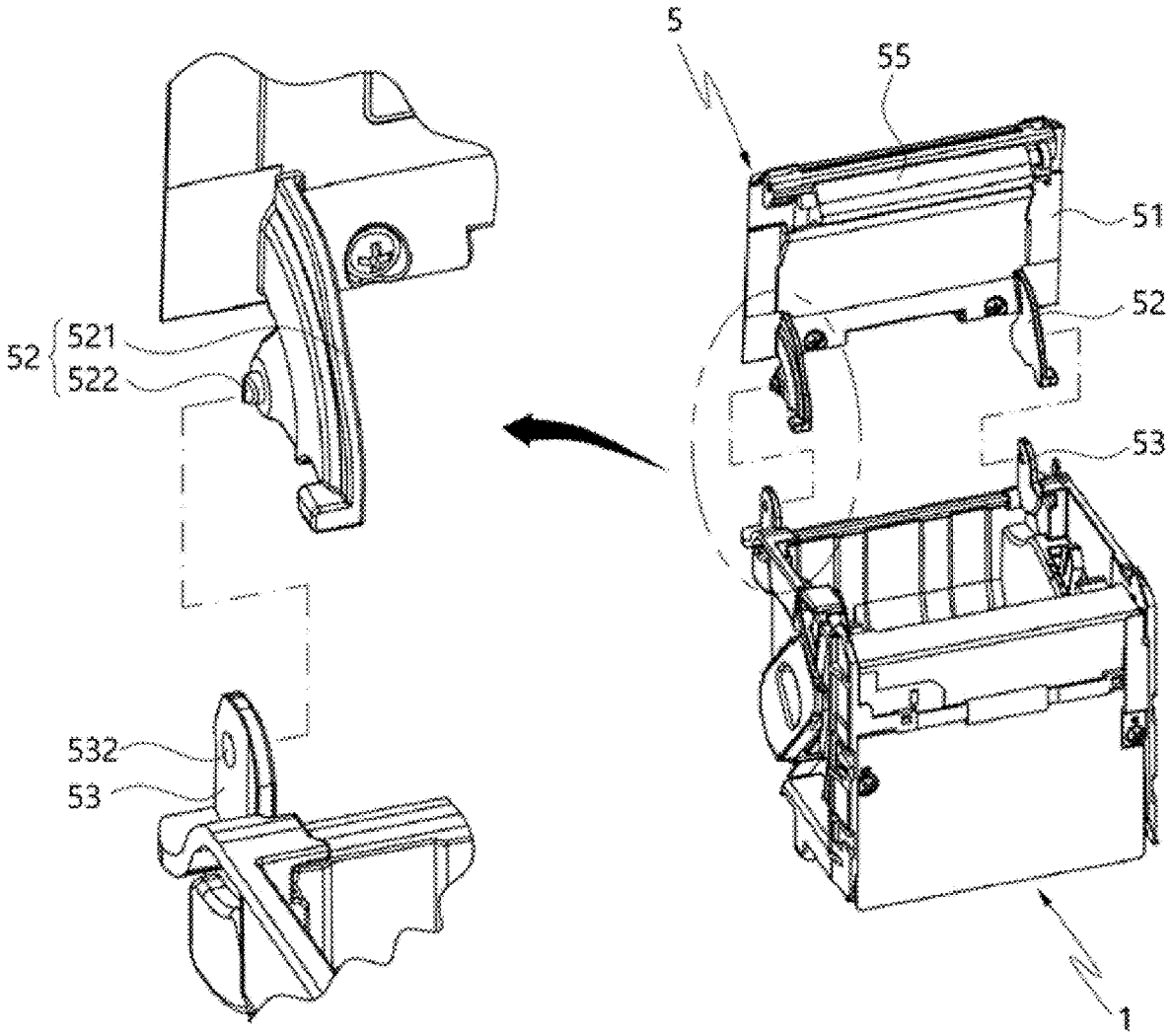
FIG. 5 is a perspective view showing an opening/closing cover part of a printer case according to an embodiment of the present invention.

FIG. 5 is a perspective view showing an opening/closing cover part of a printer case according to an embodiment of the present invention.

Referring to FIG. 5, the opening/closing cover part 5 is an upper case which is installed to be opened and closed on an upper opening portion of the printer main body 1 for paper replacement. The opening/closing cover part 5 includes a cover plate 51 covering the upper opening portion and a hinge member 52 provided on both sides of the cover plate 51 and to perform a hinge operation during opening and closing. The hinge member 52 includes an arc-shaped hinge guide part 521 and a hinge shaft 522 having a locking hook such that the opening/closing cover 5 can be installed on the printer main body 1 through a simple fitting operation. Correspondingly, the printer main body 1 has a shaft support member 53 having a hinge hole 532 into which the hinge shaft 522 is inserted.

In addition, the opening/closing cover 5 is provided with a platen roller unit 55 that is engaged with the printer head unit 2 in the closed state. The platen roller unit 55 is equipped with a platen roller or the like to transfer printing paper between the platen roller and the printer head unit 2 such that the pressing force of the printer head unit 2 is smoothly transmitted to the printing paper.

Figure 6:
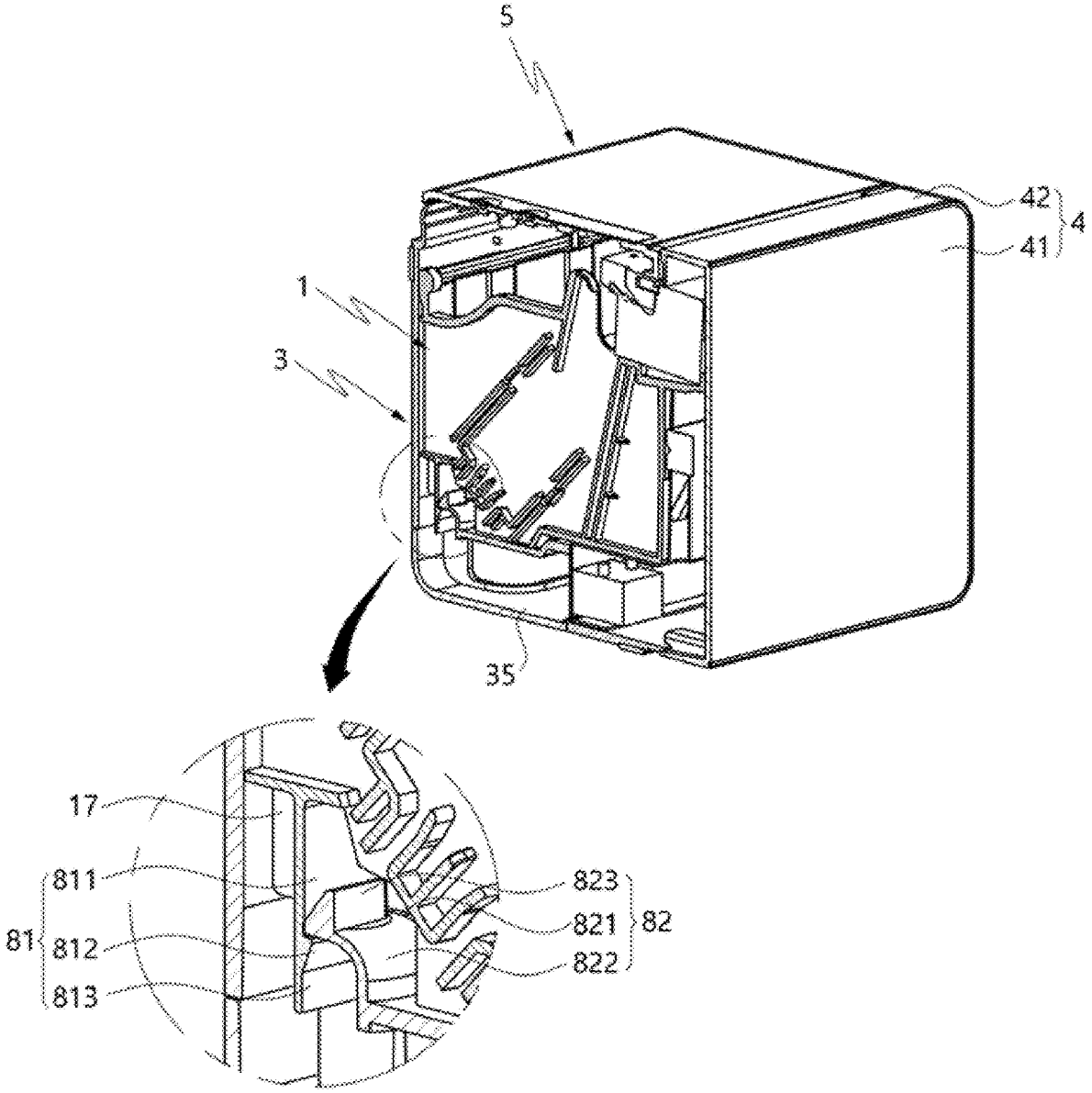
FIG. 6 is a partial cutaway perspective view for explaining a support straight member and a support straight hook portion of a printer case assembly structure according to an embodiment of the present invention.
Figure 7:
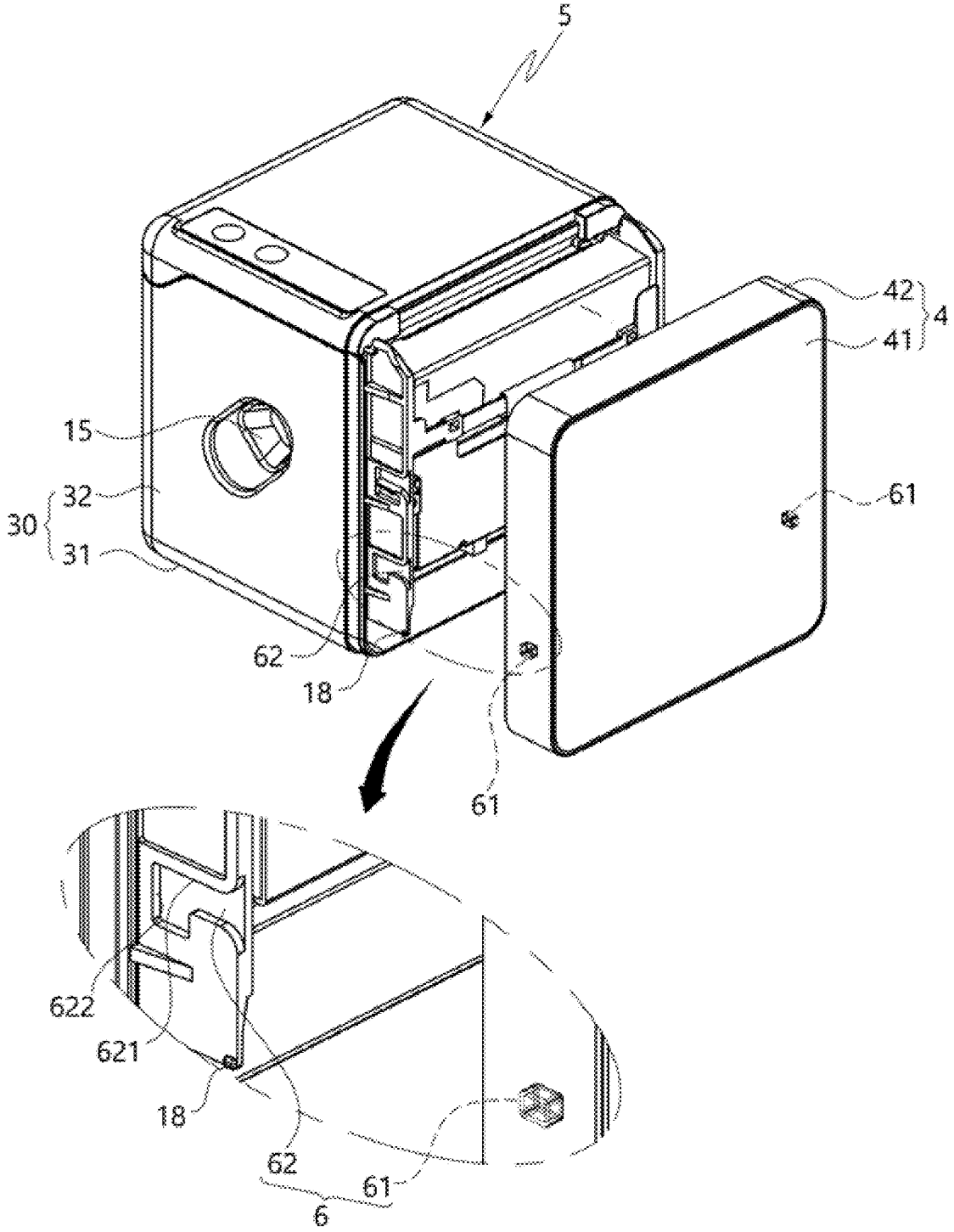
FIG. 7 is a partial cutaway perspective view of the main portion to explain the locking step of the printer case assembly structure according to an embodiment of the present invention.
Figure 8:
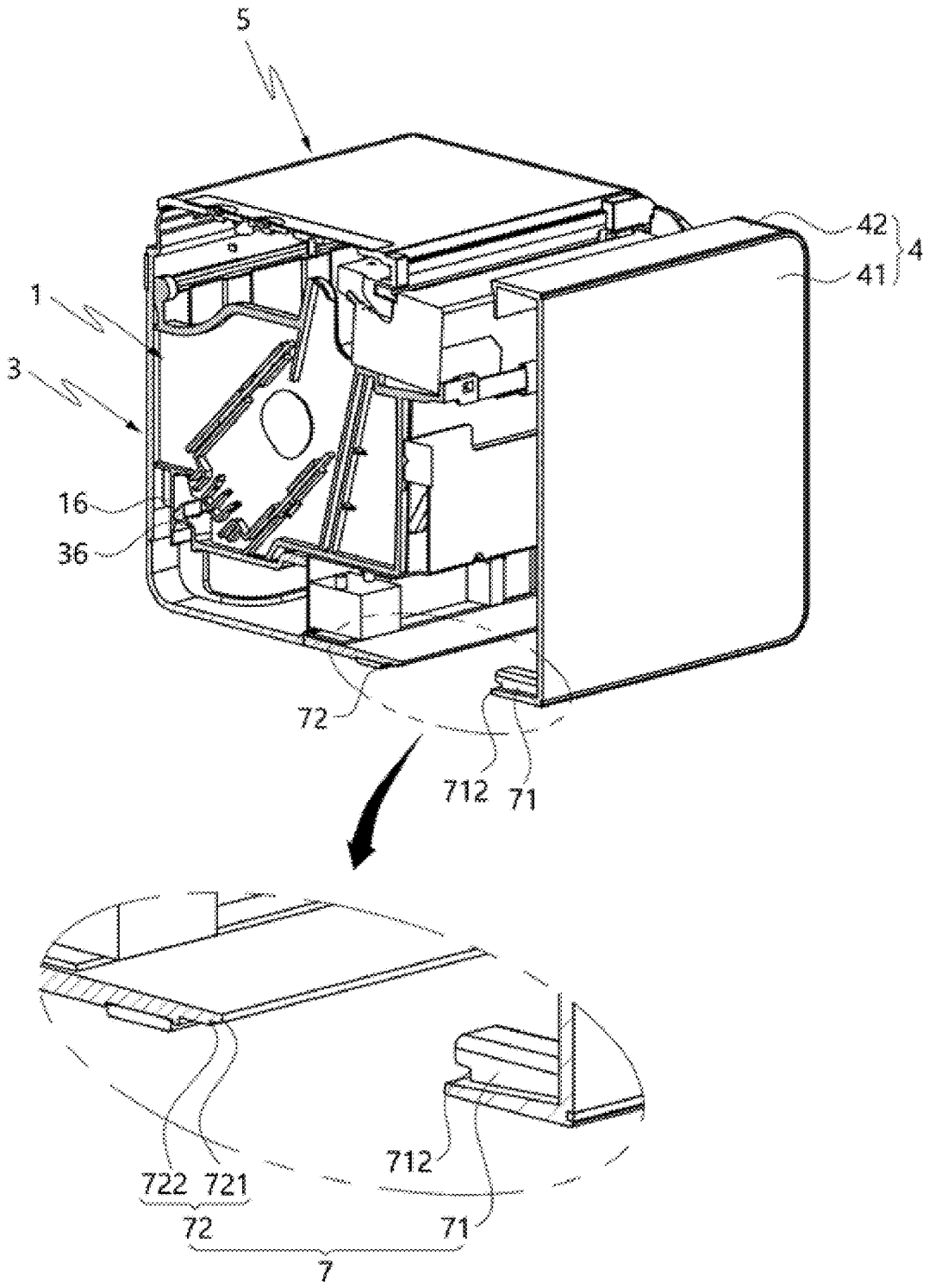
FIG. 8 is a partial cutaway perspective view illustrating a separation prevention part of a printer case assembly structure according to an exemplary embodiment of the present invention.

FIG. 6 is a partial cutaway perspective view for explaining a support straight member and a support straight hook portion of a printer case assembly structure according to an embodiment of the present invention. FIG. 7 is a perspective view of the main portion to explain the locking step of the printer case assembly structure according to an embodiment of the present invention and FIG. 8 is a partial cutaway perspective view illustrating a separation prevention part of a printer case assembly structure according to an exemplary embodiment of the present invention. For the sake of understanding, enlarged drawings have been added for a partial configuration, and enlarged portions of each drawing are clearly indicated by leader lines.

Referring to FIGS. 6 to 8, the printer case assembly structure according to an embodiment of the present invention, which is a detachable configuration for assembling/disassembly of the outer case by a manual operation, includes a latching sill part 6, a separation prevention part 7 and an assembly hook unit 8.

The latching sill part 6 is formed in the printer main body 1 and the front case 4 for the detachment of the front case 4 by a manual operation.

For example, as shown in FIG. 7, the latching sill part 6 includes a sliding protrusion 61 formed on both inner sides of the edge portion 42 of the front case 4, and a sliding protrusion moving groove 62 formed at a location facing the sliding protrusion 61 to be inserted and moved. In this case, the sliding protrusion moving groove 62 includes a horizontal moving groove 621 which is recessed on the side surface of the printer main body 1, a vertical moving groove 622 which is recessed to communicate with the horizontal moving groove 621.

The latching sill part 6 may allow the front case 4 to be coupled by vertically moving the front case 4 after horizontally moving the front case 4 toward the main case 3, but the configuration and shape illustrated in FIG. 7 are limited thereto and may be variously modified without particular limitation.

Meanwhile, as shown in FIG. 8, the separation prevention part 7, which is formed in the main case 3 and the front case 4 to prevent the front case 4 assembled with the front main body 1 from being separated, includes a separation prevention guide member 71 and a fixing protrusion 72.

The separation prevention guide member 71 protrudes from the inner surface of the lower edge portion 42 of the front case 1, and is provided in a concave structure in which a separation prevention groove 712 is provided between the lower edge portion 42 and the inner surface of a front end portion.

Correspondingly, the fixing protrusion 72, which is formed on an end portion of the bottom plate 31 facing the separation prevention guide member 71, is formed in a concave structure a protrusion 721 inserted into the separation prevention groove 712 of the separation prevention guide member 71 and a latching sill 721 engaged with the edge portion 42 below the protrusion 721.

In addition, as shown in FIG. 7, the printer main body 1 is provided with a shaking prevention protrusion 18 protruding from the contact surface with the front case 4 so that the shaking is blocked when the front case 4 is coupled. The shaking prevention protrusion 18 is in close contact with the edge portion 42 in the assembled state of the front case 4 to provide a support force, thereby preventing shaking.

The assembly hook unit 8, which is a component provided to perform the assembly and disassembly process in the detachable structure of the hook, includes a support hook member 81, and a support hook latching part 82.

The support hook member 81, which is a configuration for attaching and detaching the main case 3 to the printer main body 1 in pressing scheme without a separate assembly tool, protrudes from a lower portion of the printer main body 1 to be latched to the support hook latching part 82. The support hook member 81 includes an elastic support part 811 protruding downward from the printer main body 1 to allow the support hook member 81 to be elastically fixed to the support hook latching part 82, and a support hook 812 protruding from the elastic support part 811 in a substantially triangular barb shape.

In addition, the support hook member 81 further includes a disassembly knob 813 to more easily disassemble the main case 3 from the printer main body 1. The disassembly knob 813 is formed in the support hook 812 with a handle piece which extends integrally downward.

Meanwhile, the printer main body 1 is formed with a fixing piece 17 for more stably combining the printer main body 1 to the main case 3. The fixing piece 17 protrudes downward in contact with the support hook member 81 and is formed of a rod member having an 'E' shaped cross-sectional structure. The fixing piece is placed on the rear plate 33 during the assembly of the main case 3. In addition, the fixing surface 17 performs the function of a stopper for preventing damage by the user handling of the support hook member 81.

The support hook latching part 82 is configured to face the main case 3 to be latched to the support hook member 81. As shown in FIGS. 4 and 6, the support hook member 81 includes a hook mounting protrusion 821 into which the support hook member 81 is inserted, a reinforcement protrusion 822 formed in an arc shape and extending while being in contact with the hook mounting protrusion 821, and a guide wedge 823 formed on the reinforcement protrusion 822 to guide the combining with the support hook member 81. In this case, the hook mounting protrusion 821 is formed in the form of a rectangular box having an inlet hole 821*a* in the main body main body receiving plate 34. The guide wedge 823 is formed of a triangular member formed with an inclined surface in contact with the support hook 812.

Hereinafter, the operation of the printer case assembly structure according to an embodiment of the present invention will be briefly described with reference to FIGS. 3, 5 and 9A to 10B.

Referring to FIG. 3, according to the assembly process of the printer case according to an embodiment of the present invention, the opening/closing cover part 5 on which the platen roller unit 55 is mounted is assembled in a state in which the printer head unit 2, the drive head ratio, and the like are embedded in the printer main body 1. After assembling the front case 4 to the front of the printer main body 1, the main case 3 is assembled.

In more detail, as shown in FIG. 5, according to the assembly process of the opening/closing cover part 5, in a state in which the hinge member 52 is disposed to be opposed to the shaft support member 53 of the printer main body 1, the hinge shaft 522 is inserted into the hinge hole 532 of the shaft support member 53, so that the opening/closing cover part 5 may be easily assembled without a separate assembly tool.

Figure 9A:
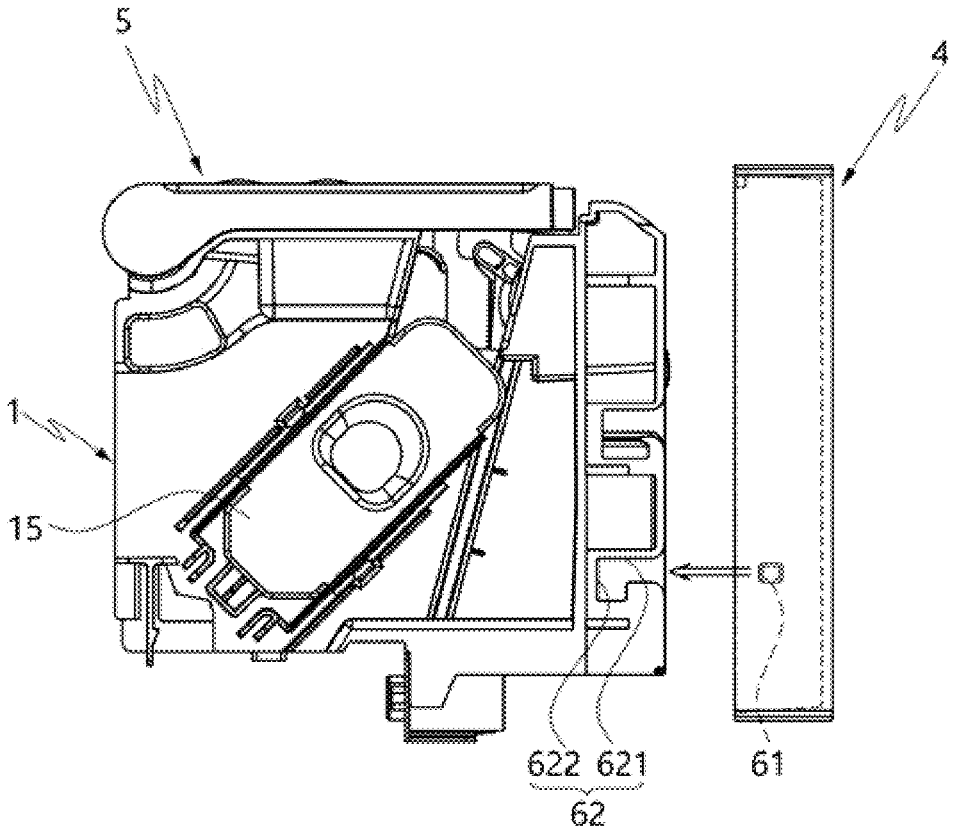
FIGS. 9A and 9B are views illustrating the assembly process of the front case in the printer case assembly structure according to an embodiment of the present invention, where
Figure 9B:
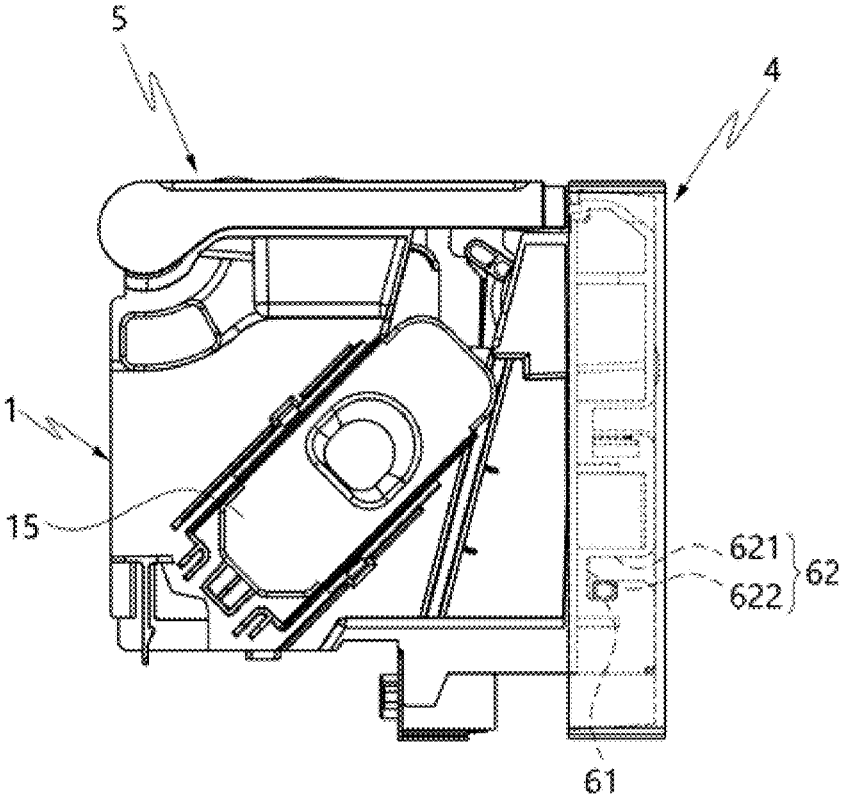

FIGS. 9A and 9B are views illustrating the assembly process of the front case in the printer case assembly structure according to an embodiment of the present invention. FIG. 9A is a schematic diagram illustrating a preparation state before the assembly of the front case. FIG. 9B is a schematic diagram illustrating a completed state of the front case assembly.

As shown in FIG. 9A and 9B, according to the assembling process of the front case 4, the sliding protrusion 61 is inserted into the sliding protrusion moving groove 62 while being arranged to face the printer main body 1. After pushing the sliding protrusion 61 to move along the horizontal moving groove 621, an external force is applied downward, so that the sliding protrusion 61 is installed after being moved along the vertical moving 622, thereby being easily assembled without a separate assembly tool. In this case, since the racking prevention protrusion 18 formed on the printer main body 1 is tightly closed to and supported by the inner surface of the edge portion 42, the shaking of the front case 4 can be prevented.

Figure 10A:
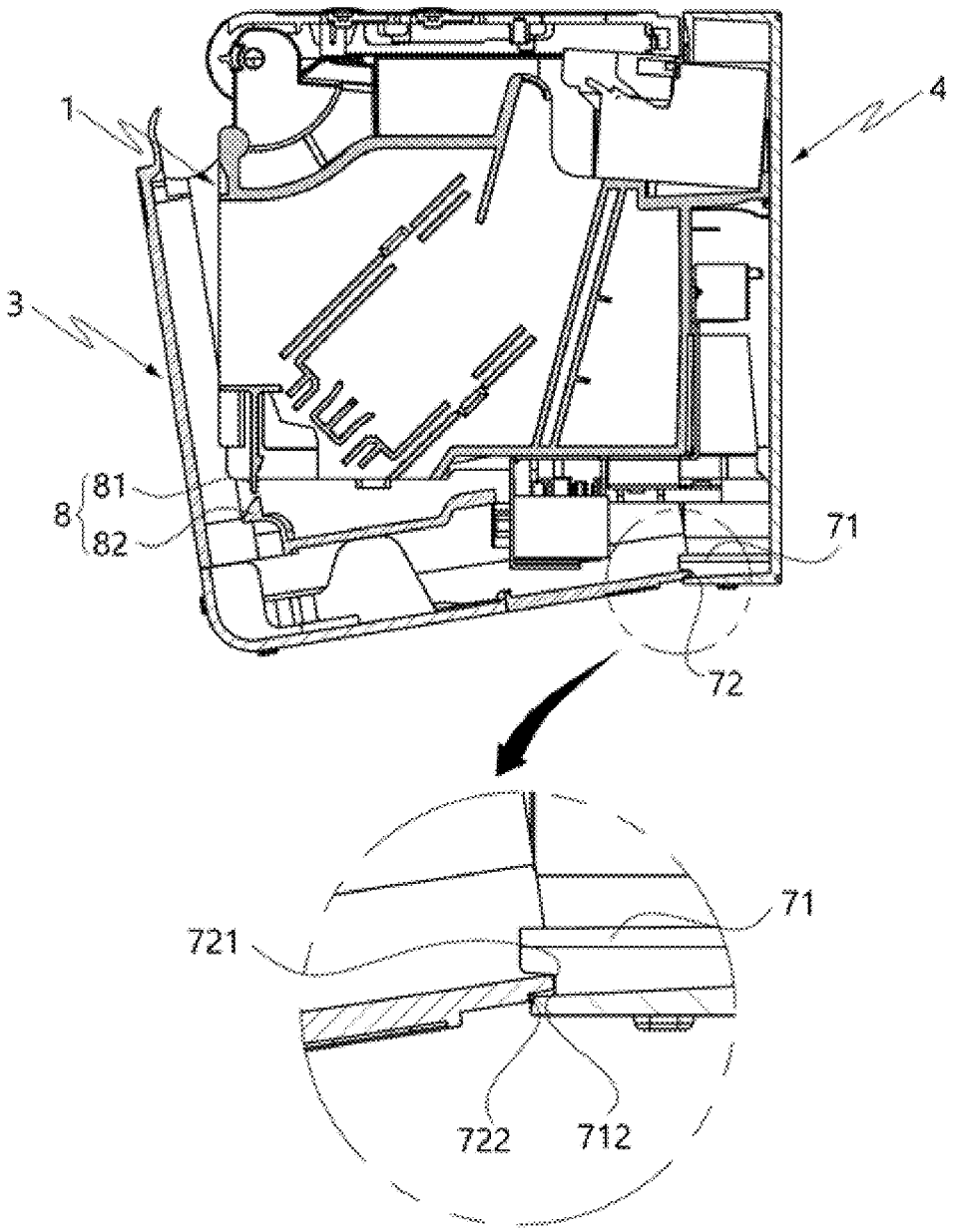
FIGS. 10A and 10B are views illustrating an assembly process of a main case in a printer case assembly structure according to an embodiment of the present invention, where
Figure 10B:
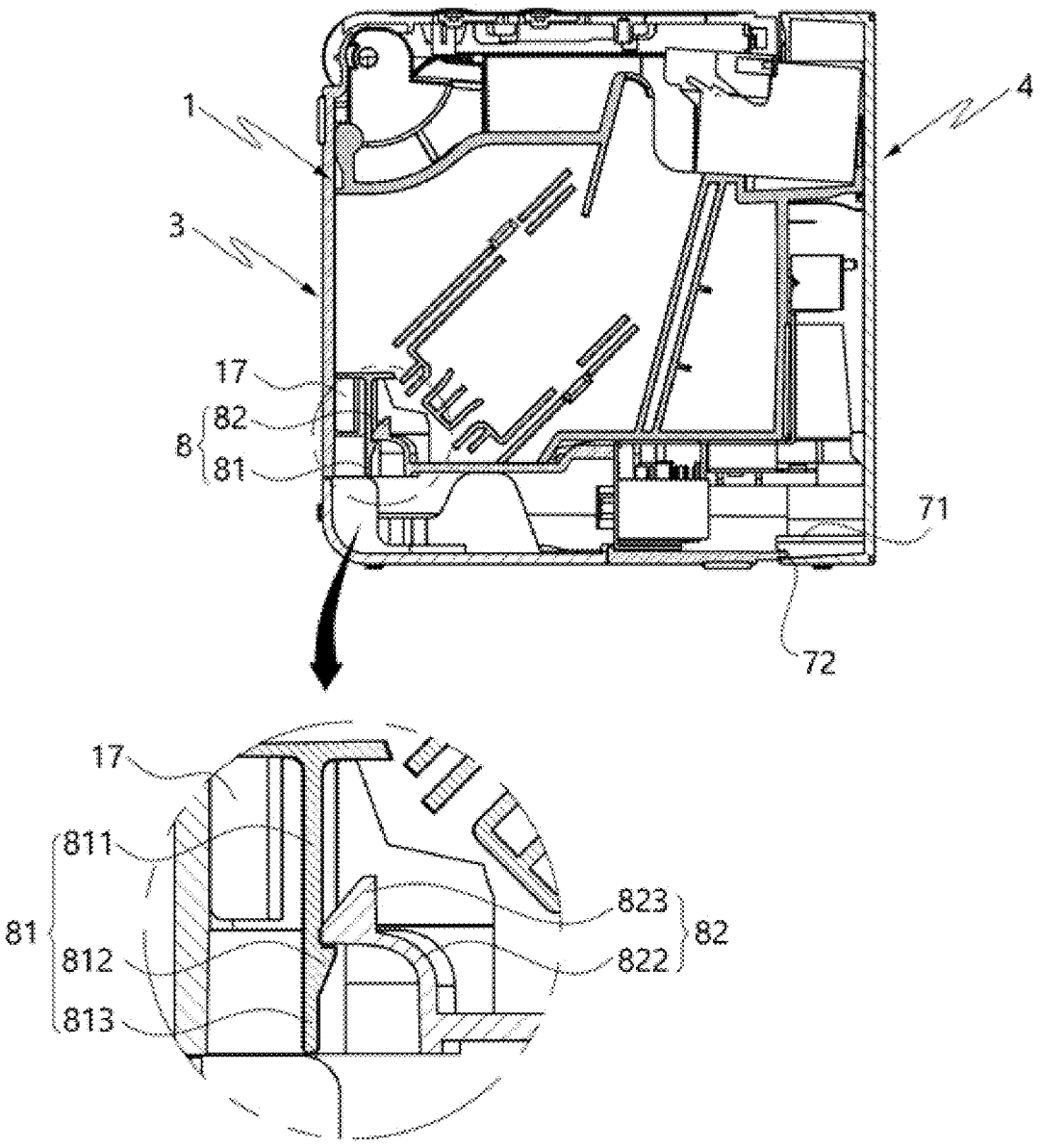

FIGS. 10A and 10B are views illustrating an assembly process of a main case in a printer case assembly structure according to an embodiment of the present invention. FIG. 10A is a schematic view illustrating a state in which the main case is temporarily assembled into the front case. FIG. 10B is a schematic view illustrating a state in which the assembly of the main case is completed.

According to the assembling process of the main case 3, first both side plates 32 are arranged at both sides of the printer main body 1, as shown in FIG. 10A, while the protrusion 721 of the fixing protrusion 72 formed on the end of the lower plate 31 is inserted into the separation prevention groove 712 of the separation prevention guide member 71 in a state where the rear plate 33 is arranged on the rear surface of the printer main body 1.

In this state, when the lower plate 31 and the rear plate 33 are pushed upward toward the printer main body 1, the support hook latching part 82 is installed while being fitted to the support hook member 81, and the latching sill 722 of the fixing protrusion 72 is engaged with the edge portion 42 of the front case 4, thereby being assembled easily without a separate assembly tool.

In addition, when the main case 3 is moved toward the printer main body 1, as shown in FIG. 10B, the inclined surface of the guide wedge 823 is in contact with the support hook 812 and is slid upward, so that the combing operation between the support hook 812 and the support hook latching part 82 while the elastic support 811 is restored after being elastically finely deformed in a rear direction.

When the assembly of the main case 3 is completed as described above, the overall assembly of the exterior case is completed in a scheme of pushing and installing the auxiliary cover member 35 that seals the opening 312 of the lower plate 31.

Meanwhile, according to the printer case assembly structure according to an embodiment of the present invention, the main case 3, the front case 4 and the opening/closing cover 5 are disassembled easily and quickly in the reverse order with respect to the above-described assembly sequence without any separate disassembling tools during maintenance and repair.

For example, since the disassembling handle 813 is provided on the support hook member 81 when disassembling the main case 3, when the user moves the disassembling handle 813 in the opening direction while grasping the disassembling handle 813 after removing the auxiliary cover member 35, while the combining between the support hook 812 and the support hook latching part 82 is released, the main case 3 is separated to be in a state similar to that shown in FIG. 10A, thereby easily disassembling the main case 3 without a separate disassembly tool.

According to the disassembly process of the front case 4, when the front case 4 is lifted up in the state of FIG. 9*b*, the sliding protrusion 61 is raised along the vertical moving groove 622. In this state, when the front case 4 is pulled outward, the front case 4 is separated while moving along the horizontal moving groove 621.

In addition, the disassembly process of the opening and closing cover part 5 is easily performed without a separate assembly tool by a simple manual operation of detaching the hinge shaft 522 of the hinge member 52 from the hinge hole 532 of the shaft support member 53.

As described above, the printer case according to an embodiment of the present invention can be quickly assembled and disassembly by a simple manual operation, thereby improving productivity and reducing production costs and maintenance costs.

Hereinafter, the configuration of the assembly hook unit 8 according to another embodiment of the present invention will be described with reference to FIGS. 11A and 11B.

Figure 11A:
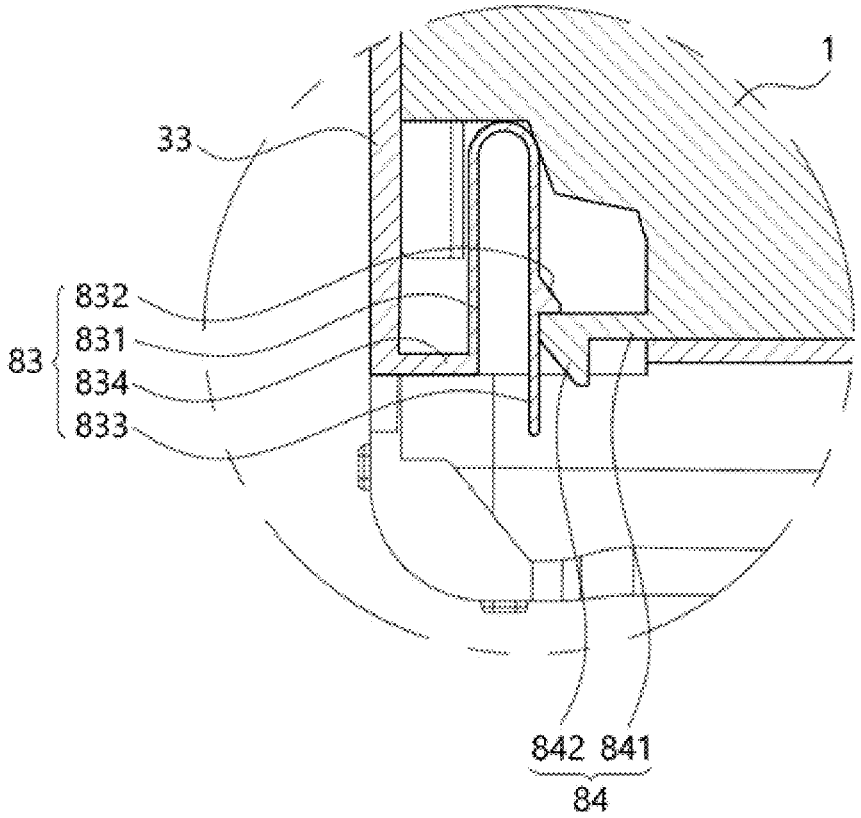
FIGS. 11A and 11B are schematic partial cross-sectional views illustrating an assembly hook unit applicable to a printer case assembly structure according to the second and third embodiments of the present invention.

FIG. 11A is a schematic partial cross-sectional view illustrating an assembly hook unit applicable to a printer case assembly structure according to a second embodiment of the present invention.

Referring to FIG. 11A, the assembly hook unit 8 according to the second embodiment of the present invention includes a support hook member 83 formed on the rear plate 33 of the main case 3, and a support hook latching part 84 formed on the printer main body 1 opposed to the support hook member 83.

The support hook member 83 includes an elastic support part 831 protruding from an extension part 834 extending inwardly from the rear plate 33, a support hook 832 protruding from the elastic support part 831 in a substantially triangular barb shape, and a disassembly handle part 833 extending from the support hook 832. The elastic support part 831 is formed in a curved structure to secure an elastic force for stable fixing. In this embodiment, the elastic support part 831 is formed substantially in an "n" shape, but the elastic support part 831 of the present invention is not limited thereto, and may be modified in various shapes according to the shapes of the printer main body 1 and the main case 3.

The support hook latching part 84, which is formed at a position opposite to the lower portion of the printer main body 1 to be latched to the support hook member 83, as shown in FIG. 11A, includes a hook receiving protrusion 841 protruding from the printer main body 1, and a guide wedge 842 formed on the hook receiving protrusion 841 to guide the combining with the support hook member 83.

Figure 11B:
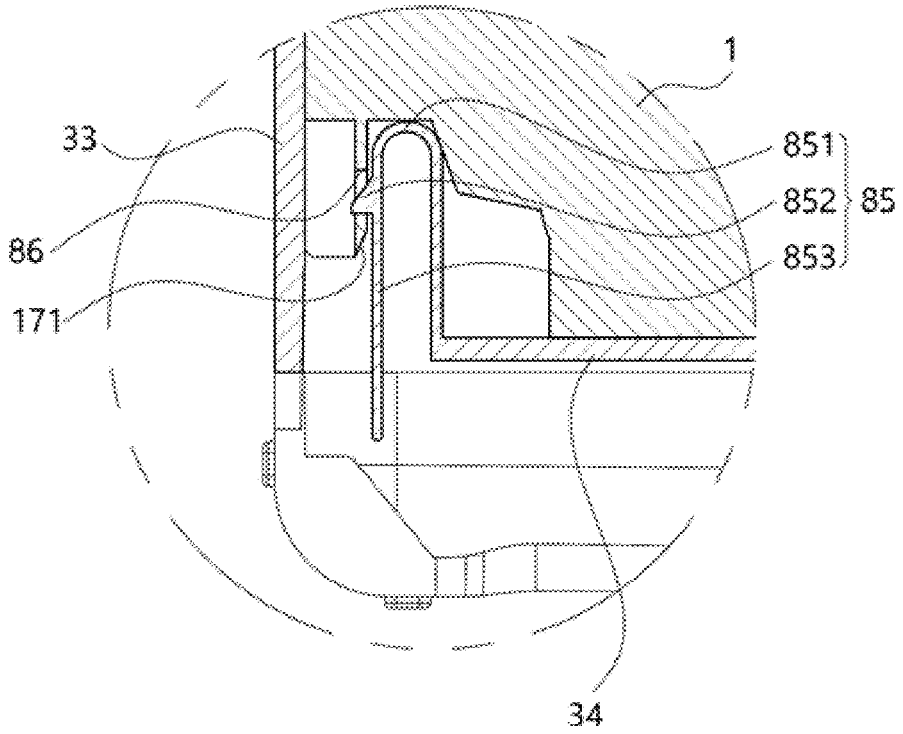

FIG. 11B is a schematic partial cross-sectional view illustrating an assembly hook unit applicable to a printer case assembly structure according to a third embodiment of the present invention.

Referring to FIG. 11B, the assembly hook unit 8 according to the third embodiment of the present invention includes a support hook member 85 formed on the main body placing plate 34 of the main case 3, and a support hook latching part 86 formed on the printer main body 1 opposed to the support hook member 85.

The support hook member 85 includes an elastic support part 851 protruding upward from the main body receiving plate 34, a support hook 852 protruding from the elastic support part 851 in a substantially triangular barb shape, and a disassembly handle part 853 extending downward from the support hook 832. In this case, the elastic support part 851 is formed substantially in a curved structure of an "n" shape to have an elastic force for stable fixing.

The support hook latching part 86 includes a hook latching hole formed on the fixing piece 17 of the printer main body 1 to be latched to the support hook member 85. In addition, an inclined surface 171 is formed on a lower end of the fixing piece 17 to guide the combining with the support hook member 83.

Since the assembling and disassembling process based on the assembling hook unit 8 according to the second and third embodiments of the present invention is almost the same as the assembling and disassembling process of the assembling hook unit according to the first embodiment, the duplicate description will be omitted for clarity.

As understood through the above description, although the configuration and assembly/disassembly of the printer according to an embodiment of the present invention has been described above, but those skilled in the art can understand that it is possible to substitute and modify some of the above-described embodiment in the range without departing from the technical spirit of the present invention.

Therefore, it will be understood that all the technical spirits within the equivalent range fall within the scope of the present disclosure.

What is claimed is:

1. A printer case assembly structure comprising:

a printer main body;

a front case configured to be detachably attached at a front portion of the printer main body;

a main case configured to surround the printer main body except for a front installation area for the front case and an upper installation area for a cover;

a latching sill formed in the printer main body and in the front case to assemble the front case with the printer main body; and a hook assembly formed in the printer main body and in the main case to assemble the main case with the printer main body, wherein the main case includes a main body receiving plate extending parallel to a bottom plate of the main case, and the main body receiving plate has a plate-shaped body, and wherein a main body support protrusion part placed on a bottom portion of the printer main body is formed at a free end of the plate-shaped body.

2. The printer case assembly structure of claim 1, wherein the hook assembly includes:

a support hook member including an elastic support protruding from the printer main body and a support hook formed on the elastic support; and a support hook latch formed in the main case for facing the support hook member to be latched with the support hook member.

3. The printer case assembly structure of claim 2, wherein the support hook member further includes a disassembly handle.

4. The printer case assembly structure of claim 2, wherein the main case further includes:

the bottom plate having an opening; and side plates placed on both lateral sides of the bottom plate, a rear plate placed on a rear portion of the bottom plate.

5. The printer case assembly structure of claim 4, wherein the support hook latch is formed at one side of the plate-shaped body of the main body receiving plate.

6. The printer case assembly structure of claim 1, wherein the hook assembly includes:

a support hook member including an elastic support protruding from the main case and a support hook formed on the elastic support; and a support hook latch formed in the printer main body for facing the support hook member to be latched with the support hook member.

7. The printer case assembly structure of claim 6, wherein the support hook member further includes a disassembly handle.

8. The printer case assembly structure of claim 1, further comprising a separation prevention assembly formed in the front and main cases to prevent the front case from being separated from the latching sill, wherein the separation prevention assembly includes:

a separation prevention groove formed in the front case; and a protrusion formed at an end of the main case for facing the separation prevention groove to be inserted into the separation prevention groove.

9. The printer case assembly structure of claim 1, further comprising a shaking prevention protrusion formed on a contact portion between the printer main body and the front case to prevent the front case coupled to the printer main body from shaking.

10. The printer case assembly structure of claim 1, further comprising an opening/closing cover connected to the printer main body, the opening/closing cover being opened and closed for paper replacement, wherein the opening/closing cover includes a hinge member including a hinge shaft having a latching hook in an arc-shaped hinge guide, and wherein the printer main body includes a shaft support member having a hinge hole into which the hinge shaft is to be inserted.

11. A printer case assembly structure comprising:

a printer main body;

a front case configured to be detachably attached at a front portion of the printer main body;

a main case configured to surround the printer main body except for a front installation area for the front case and an upper installation area for a cover; and a hook assembly formed in the printer main body and in the main case to assemble the main case with the printer main body, wherein the hook assembly includes:

a support hook member including an elastic support protruding from the printer main body and a support hook formed on the elastic support; and a support hook latch formed in the main case for facing the support hook member to be latched with the support hook member, wherein the support hook latch includes:

a hook receiving protrusion forming an insertion hole into which the support hook is to be inserted;

a reinforcing protrusion extending from the hook receiving protrusion; and a guide wedge formed on an upper portion of the reinforcing protrusion to guide the support hook member.

12. A printer case assembly structure comprising:

a printer main body;

a front case configured to be detachably attached at a front portion of the printer main body;

a main case configured to surround the printer main body except for a front installation area for the front case and an upper installation area for a cover;

a latching sill formed in the printer main body and in the front case to assemble the front case with the printer main body; and a hook assembly formed in the printer main body and in the main case to assemble the main case with the printer main body, wherein the latching sill includes:

a sliding protrusion formed at both lateral sides of the first case; and a sliding protrusion moving groove including a horizontal moving groove formed in the printer main body facing the sliding protrusion, and a vertical moving groove communicating with the horizontal moving groove.

* * * * *